US006487881B1

(12) United States Patent
Adele

(10) Patent No.: US 6,487,881 B1
(45) Date of Patent: Dec. 3, 2002

(54) INTERLOCKING DYEING SUPPORT

(76) Inventor: Calvi Maria Adele, Via N. Machiavelli 40, 59100 Prato (IT)

( * ) Notice: Subject to any disclaimer, the term of this patent is extended or adjusted under 35 U.S.C. 154(b) by 0 days.

(21) Appl. No.: 09/674,744

(22) PCT Filed: May 12, 1999

(86) PCT No.: PCT/IT99/00132

§ 371 (c)(1),
(2), (4) Date: Dec. 27, 2000

(87) PCT Pub. No.: WO99/60196

PCT Pub. Date: Nov. 25, 1999

(51) Int. Cl.[7] ..... B65H 75/10; B65H 75/18; D06B 5/18

(52) U.S. Cl. ..... 68/198; 242/118.1; 242/118.3

(58) Field of Search ..... 68/198; 242/118.1, 242/118.11, 118.3

(56) References Cited

U.S. PATENT DOCUMENTS 2,640,341 A * 6/1953 Russell ..... 68/198
4,667,895 A * 5/1987 Becker et al. ..... 68/198 X
5,178,342 A * 1/1993 Romagnoli ..... 242/118.1
5,255,870 A * 10/1993 Romagnoli ..... 242/118.1

FOREIGN PATENT DOCUMENTS

| | | |
|---|---|---|
| EP | 0 208 974 A | 1/1987 |
| EP | 0 536 097 A | 4/1993 |
| IT | 0 217 217 Z | 11/1991 |

* cited by examiner

*Primary Examiner*—Philip Coe
(74) *Attorney, Agent, or Firm*—McGlew and Tuttle, P.C.

(57) ABSTRACT

The support has an inside surface (1A) that is basically cylindrical for approximately three fourths of the axial length from the smaller-diameter end (1B), an annular step (1C) and a remaining cylindrical internal section (1E) of increased diameter for interlocking purposes; the outside surface is basically frustoconical for a section (1G) of approximately three fourths of the axial length from the larger-diameter end (1H), and its remaining cylindrical section (1F) corresponds in diameter to the remaining cylindrical internal section (1E); and for approximately the half of the larger dimensions of the wall of the support there are perforations (3) that extend transversely in the form of slots, while enlarged perforations (5) are formed in the other approximate half of the height.

8 Claims, 2 Drawing Sheets

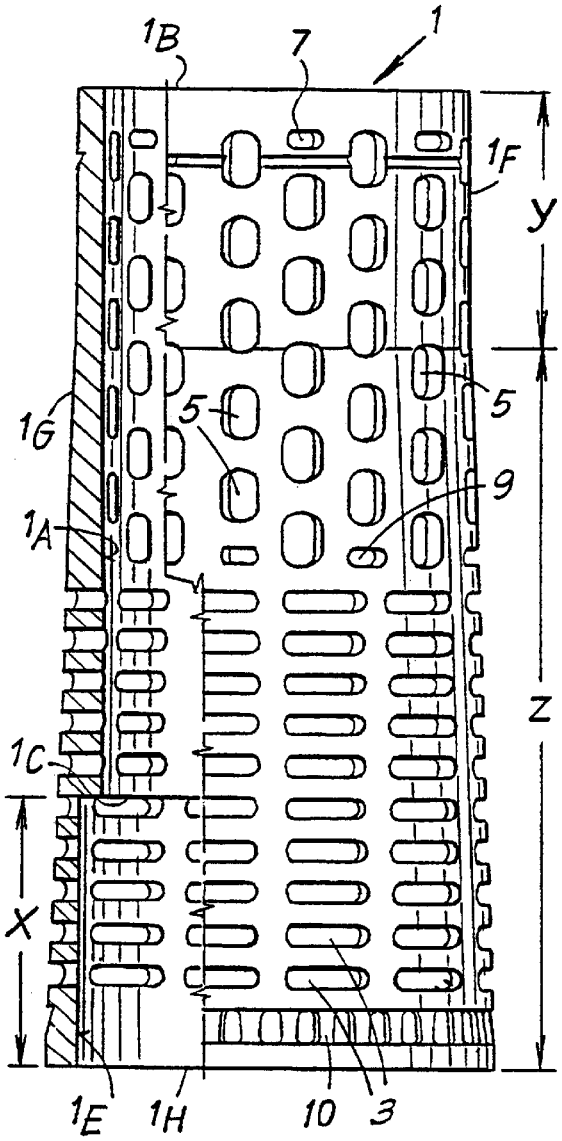
Fig.1
Fig.3
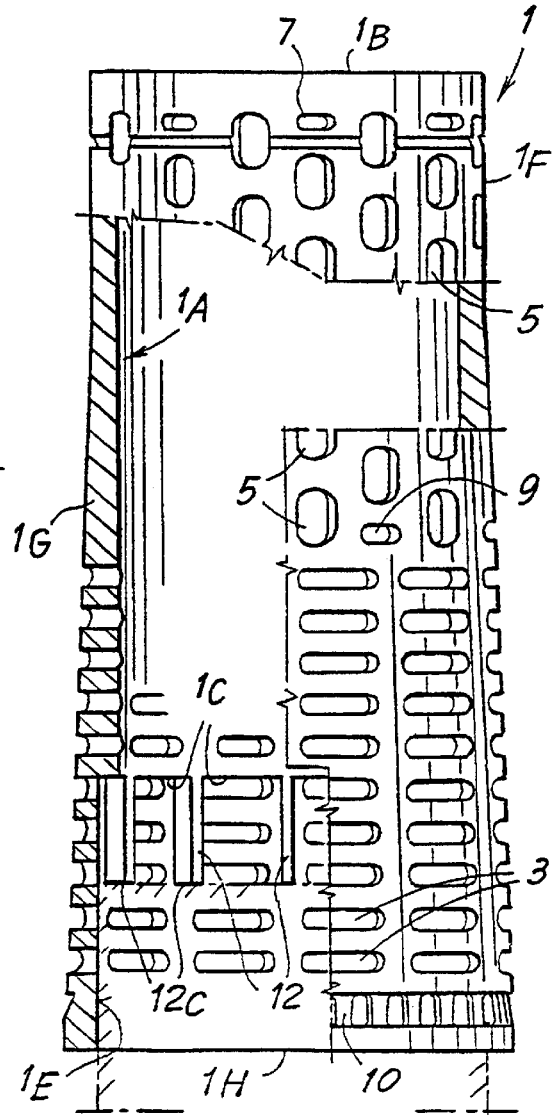

INTERLOCKING DYEING SUPPORT

FIELD AND BACKGROUND OF THE INVENTION

The invention relates to a molded synthetic-resin support, i.e. center, particularly for winding machines, of the type known as interlocking supports, for the formation thereon of yarn packages having to be put through dyeing and sometimes also, centrifuging operations, the wall of the support or center being perforated to allow dye to flow from the outside in and from the inside out. The support according to the innovation represents an improvement on supports of the abovementioned type currently in use, such as those disclosed in U.S. Pat. No. 536,097 and the like, in that it offers greater resistance to the mechanical and thermal stresses to which these supports or centers are subjected during dyeing (because of the high temperatures reached) and during centrifuging. The mechanical stresses are due to many causes that are familiar to experts and are obvious. In particular, stresses during centrifuging are becoming ever greater because of the trend towards accelerating the process of drying by centrifuging.

SUMMARY AND OBJECTS OF THE INVENTION

The invention makes it possible to achieve great resistance to stresses such as those mentioned above, although limiting the thicknesses and weight of material with a morphology which limits mold costs and molding times, and also achieving adequate uniformty of dyeing by means of the configuration of the perforations. These and other objects and advantages will be apparent from the text which follows.

The invention makes it possible to achieve great resistance to stresses such as those mentioned above, although limiting the thicknesses and weight of material with a morphology which limits mold costs and molding times, and also achieving adequate uniformity of dyeing by means of the configuration of the perforations. These and other objects and advantages will be apparent from the text which follows.

Basically, according to the invention:

- the inside surface is basically cylindrical for approximately three fourths of the axial length. from the smaller-diameter end and has an annular step and a remaining cylindrical internal section of increased diameter for interlocking purposes;
- the outside surface is basically frustoconical for approximately three fourths of the axial length from the larger-diameter end and its remaining cylindrical section corresponds in diameter to said remaining cylindrical internal section for interlocking purposes;
- and for approximately the half of larger dimensions of the wall of the support the perforations are in the form of slots that extend transversely, while for the remaining portion there are perforations that also extend longitudinally.

With simple adaptations it is possible to provide internal longitudinal ribs extending from said annular step, in order to reduce the interlocking length.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 shows a side view and partial section of a support or center under consideration;

FIG. 3 shows a view similar to that of FIG. 1, illustrating an alternative embodiment for reducing the interlocking height between two centers fitted on top of each other.

DESCRIPTION OF THE PREFERRED EMBODIMENT

Figure 2:
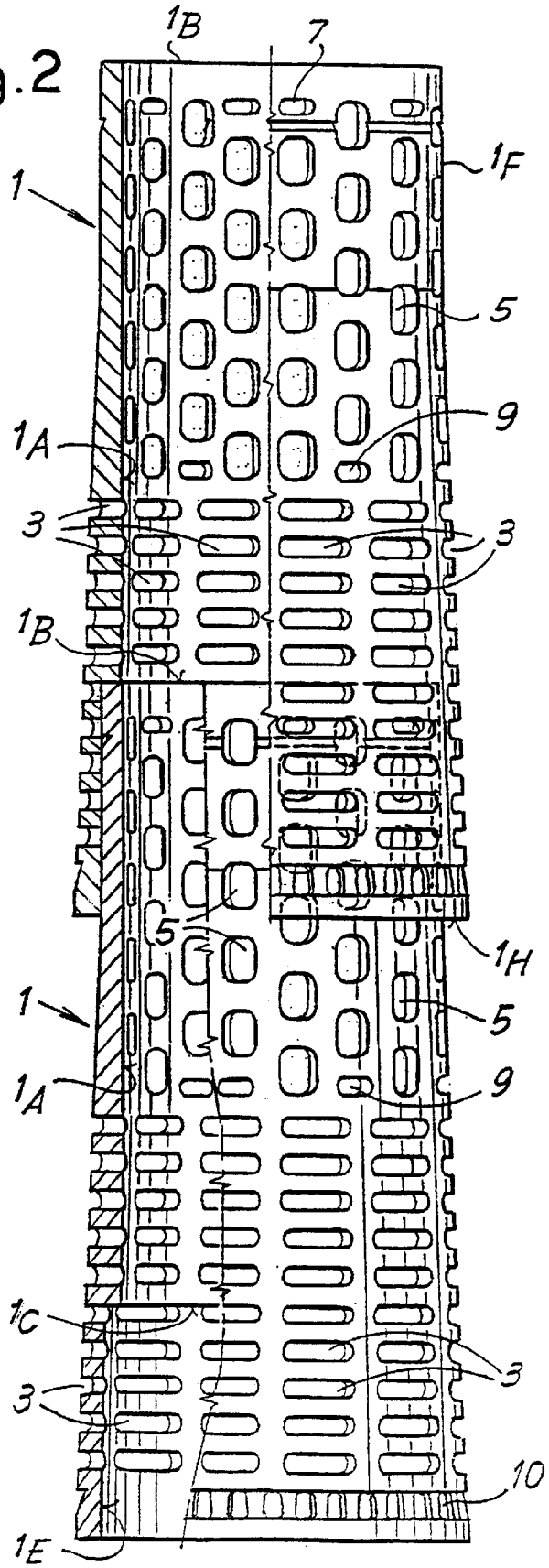
FIG. 2 shows two centers fitted on top of each other in an interlocking manner, both in side view and partial section.

As illustrated in the accompanying drawing, the number 1 is a general reference for a support or center which is made from molded synthetic resin for the accumulation upon it of a yarn package intended for dyeing by the penetration of liquid dye from the inside out and from the outside in, and for possible centrifuging in order to speed up the drying process.

As illustrated, the support or center is of basically tubular shape but with a taper to allow successive centers or supports to interlock when fitted on top of each other coaxially and with partial insertion of the top end (when viewing the drawing) of one center in a seat formed in the bottom of another center, as illustrated particularly for the two supports or centers shown in FIG. 2. Specifically, according to the invention, the center has an inside surface 1A that is basically cylindrical for approximately three fourths of the length from the top edge 1B (when viewing; the drawing) of the support, as far as an annular step 1C, beyond which the inside surface of the center, for approximately one fourth of the total axial length of the center or support, has surface 1E. The axial length of the surface 1E, marked X, is about one fourth of the axial dimension of the support.

The support or center is defined externally by a cylindrical surface 1F that extends for a distance Y of the same order of magnitude as the distance X, that is to say for approximately one fourth of the axial length of the support; the diameter of this section 1F is approximately equal to the diameter of the inside surface 1E defined above. For the rest of the outside surface, that is to say for the distance Z of approximately three fourths of the total length of the support or center, the form of the surface 1G is approximately frustoconical beginning at the larger base 1H of the center, which is the bottom end when viewing the drawing.

The tubular support 1 is conventionally given perforations distributed appropriately to allow the passage of the liquid dye during dyeing operations. These perforations have been designed to ensure the strength of the support or center in relation to, among other things, the thickness of the support in relation to the above-defined form of the inside and outside surfaces, and therefore in relation to the variable thickness of the center. In particular, according to the innovation, at the bottom end when viewing the drawing, that is to say beginning at the larger base 1H of the frustoconical surface 1G, the support comprises a plurality of annular series of slots 3 that extend transversely with respect to the axis of the support, whereas for the remaining part of approximately one half of the total length of the support, this is provided with perforations 5 having greater extension in the longitudinal direction than in the transverse direction, and with a suitably radiused and oval-like outline. The perforations 5 are arranged in longitudinal lines with the perforations of one line preferably staggered relative to those of the adjacent lines, for reasons of strength, i.e. in order to maintain an annular cross section sufficient to withstand the stresses which the support or center experiences during the processes through which the yarn accumulated upon it is put. The support is also given other suitable perforations such as 7 and 9 for reasons of uniformity and distribution of the through holes for the dye liquid. Near the larger base 1H is a conventional formation 10 for reasons of functionality of the center and in particular to facilitate the accumulation of a reserve of yarn.

The distribution of the perforations 3 and 5, in combination with the variation of the thicknesses resulting from the above-defined surface configuration of the support or center, has the effect in the first place of giving the center greater strength than that achieved with the centers or supports of the prior art referred to earlier, thus giving the clear advantages already discussed. In the second place, it is made easily possible to mold individual parts from relatively simple molds and with molding cycle times that permit a substantial cost saving. Moreover, the arrangement described above reduces to a minimum the weight of material required to produce each support or center.

These and other advantages will be clear in view of the functions required of the center and in particular in view of the mechanical and thermal stresses to which the center or support is subjected during the processing of the yarn accumulated upon it, particularly in the dyeing stages, and also as regards the mechanical stresses applied to the center during centrifuging of the sets of packages accumulated on centers fitted on top of each other in an interlocking manner, with section 1F of one center fitted inside the seat formed by section 1E on the inside surface into which it is pushed until the edge 1B meets the step 1C of the center above it, as clearly illustrated in FIG. 2.

By a simple morphological modification to the support or center it is possible to modify its configuration in order to make the interlocking length shorter than the length X which corresponds to the length of the cylindrical inside surface 1E. For this purpose it is sufficient to modify the mold so as to create a number of ribs 12 as shown in FIG. 3 leading away from the annular step 1C described earlier; in this way a discontinuous annular shoulder 12C is formed by the ends of the ribs 12 on the modified support or center as shown in FIG. 3, instead of the shoulder represented by the annular step 1C described earlier, and by this means the interlocking length between centers fitted on top of each other is reduced.

The configuration of the perforations, which are visible in the part shown in external view of the centers or supports (and not in the views of the sectioned parts, in order to keep the drawing simple) makes for easy molding, in consideration of the thicknesses of the various portions of the support, and also of the strength required to support the support or center during the operations to which the latter is subject.

What is claimed is:

1. A dyeing support for yarn packages the support comprising:

a tubular wall being perforated to allow dye to flow in centrifugal, and centripetal directions; said wall having an axial length and having first and second axial ends, said first end having a smaller diameter than said second end, said tubular wall has an inside and outside surface;

said inside surface of said wall is basically cylindrical for approximately three fourths of said axial length from the smaller-diameter end, said inside surface has an annular step and a remaining cylindrical internal section of larger diameter;

said outside surface is basically frustoconical for approximately three fourths of the axial length from the larger-diameter end, and a remaining cylindrical section of said outside surface corresponds in diameter to said remaining cylindrical internal section for interlocking purposes of one dyeing support with another dyeing support;

and for approximately half of larger diametrical dimensions of the wall of the support perforations of said wall are in the form of slots that extend transversely, and for a remaining portion of said wall there are perforations that extend longitudinally.

2. A support as claimed in claim 1, further comprising: longitudinal ribs extending from said annular step, in order to reduce an interlocking length of said second inside portion.

3. A dyeing support for yarn packages, the support comprising:

a smaller-diameter end, a larger-diameter end and a perforated wall extending for an axial length there between, said wall being provided with transversely extending slots and perforations which extend longitudinally;

an inside surface of said wall having an essentially cylindrical first portion of smaller diameter, extending for a first axial length of said support starting from said smaller-diameter end;

said inside surface having a second cylindrical internal portion of larger diameter;

an outside surface of said wall having an essentially frustoconical portion and a cylindrical portion having a diameter corresponding to said diameter of said cylindrical internal portion of larger diameter;

said essentially cylindrical first portion of the inside surface of said wall extends for approximately three fourths of said axial length of said wall and ends with an annular step;

said second cylindrical internal portion of larger diameter extending for a remaining of the axial length of said wall;

said essentially frustoconical portion of said outside surface extends for approximately three fourths of said axial length of said wall from said larger-diameter end, a remaining portion of said outside surface being cylindrical;

said slots are provided along approximately half of said axial length of said wall starting from said larger-diameter end;

said longitudinally extending perforations being provided along a remaining half of said axial length of said wall.

4. A support as claimed in claim 3, further comprising:

longitudinal ribs extending from said annular step, in order to reduce a length of said second cylindrical internal portion of larger diameter.

5. A support as claimed in claim 5, wherein:

said perforations have a greater extension in a longitudinal direction than in a transverse direction and have a suitably radiused and oval-like outline.

6. A support as claimed in claim 3, wherein:

said perforations have a greater extension in a longitudinal direction than in a transverse direction and have a suitably radiused and oval-like outline.

7. A dyeing support comprising:

a tubular wall having first and second axial ends, and having a radially inside and outside surface, said first end having a smaller diameter than said second end;

said inside surface having a first inside portion adjacent said first end and a second inside portion adjacent said second end;

said first inside portion having a smaller diameter than a diameter of said second inside portion;

said inside surface includes an annular step between said first and second inside portions;

said outside surface having a first outside portion adjacent said first end and a second outside portion adjacent said second end;

said first outside portion having a diameter corresponding to said diameter of said second inside portion;

said second outside portion being substantially frusto-conical;

said tubular wall having a first wall portion adjacent said first end and a second wall portion adjacent said second end;

said first wall portion defines a first plurality of slots extending in an axial direction of said tubular wall;

said second wall portion defines a second plurality of slots extending in a circumferential direction of said tubular wall.

8. A support in accordance with claim 7, wherein:

said tubular wall has an axial length;

said first inside portion has an axial length of approximately three fourths of said axial length of said tubular wall;

said second outside portion has an axial length of approximately three fourths of said axial length of said tubular wall;

said first and second wall portions have an axial length of approximately one half of said axial length of said tubular wall;

said first inside portion has a substantially constant diameter over an axial length of said first inside portion;

said second inside portion has a substantially constant diameter over an axial length of said second inside portion;

said first outside portion corresponds in diameter to said second inside portion for interlocking purposes of one dyeing support with another dyeing support.

* * * * *